United States Patent [19]

Barrow

[11] 4,214,453

[45] Jul. 29, 1980

[54] INJECTOR COOLER CONTROLS

[76] Inventor: Billy E. Barrow, 2434 Funston St., Hollywood, Fla. 33020

[21] Appl. No.: 10,804

[22] Filed: Feb. 9, 1979

[51] Int. Cl.[3] ..... F25D 17/02

[52] U.S. Cl. ..... 62/118; 62/509; 62/83; 62/221

[58] Field of Search ..... 62/219, 220, 221, 509, 62/83, 118

[56] References Cited

U.S. PATENT DOCUMENTS

| | | | |
|---|---|---|---|
| 1,994,037 | 3/1935 | Gay | 62/221 X |
| 2,554,920 | 5/1951 | Phillips | 62/221 X |
| 2,590,741 | 3/1952 | Watkins | 62/509 X |
| 2,778,195 | 1/1957 | Christensen | 62/509 X |

*Primary Examiner*—Albert J. Makay
*Assistant Examiner*—Henry Bennett
*Attorney, Agent, or Firm*—Malin & Haley

[57] ABSTRACT

An injector cooler control system which controls the flow of refrigerant from a common receiver that ties a common refrigeration plant to more than one injector cooler systems. The control system limits the amount of liquid refrigerant entering a cooler surge tank by limiting the amount of liquid refrigerant passing from the receiver through an injector valve, thus preventing liquid carryover to the compressor of a common refrigeration plant.

4 Claims, 1 Drawing Figure

INJECTOR COOLER CONTROLS

BACKGROUND OF THE INVENTION

This invention relates to the operation of the refrigerant control system in an injector cooler and more particularly to the control of the refrigerant system when more than one injector type cooler is connected to a common refrigerant plant.

Heretofore, industries that use injector type cooler refrigeration systems, such as the soft drink industry, have had to use separate refrigeration plants for each injector type cooler. Individual refrigeration plants had to be used because the injector cooler system is a low side critical fixed charged unit which passed the entire charge, and thus cannot be connected to other injector coolers through a common refrigeration plant.

SUMMARY

The present invention relates to a new and improved control system for an injector type cooler in which two or more injector coolers are connected to a common refrigeration plant.

In the present invention liquid level control systems detect the liquid refrigerant level in a surge tank, which is located on the suction side of the compressor, and control the flow of refrigerant from a common receiver. The entire quantity of refrigerant stored in the receiver is prevented from being passed into the low side of the refrigerant system by closing a control valve in the primary liquid loop and opening a control valve in the bypass vapor loop when a high level control point is reached in the surge tank. Thus, the liquid from the receiver will no longer flow through the injector nozzle and be carried over into the compressor after flooding the surge vessel. However, vapor will now enter the injector nozzle from the receiver through the bypass loop, and draw down liquid refrigerant from the surge tank. When the level in the surge tank reaches a low level control point, the control system will close the vapor bypass loop and open the primary liquid loop.

It is therefore the principal object of this invention to provide means to connect two or more injector coolers into a common refrigeration system.

It is another object of this invention to provide a means to prevent carry over into the low side of the compressor of a common refrigeration system.

It is still another object of this invention to provide means to save electric energy in injector cooler systems by combining many refrigeration systems with individual components into a common refrigeration system.

It is a further object of this invention to provide continued normal operation of some of the connected injector coolers while other injector coolers are removed from service for maintenance.

It is a still further object of this invention to provide means for starting up an injector cooler system with a low load or during a cold morning start up situation.

In accordance with these and other objects which will be apparent hereinafter, the instant invention will now be described with particular reference to the accompanying drawings.

DESCRIPTION OF THE PREFERRED EMBODIMENT

Figure 1:
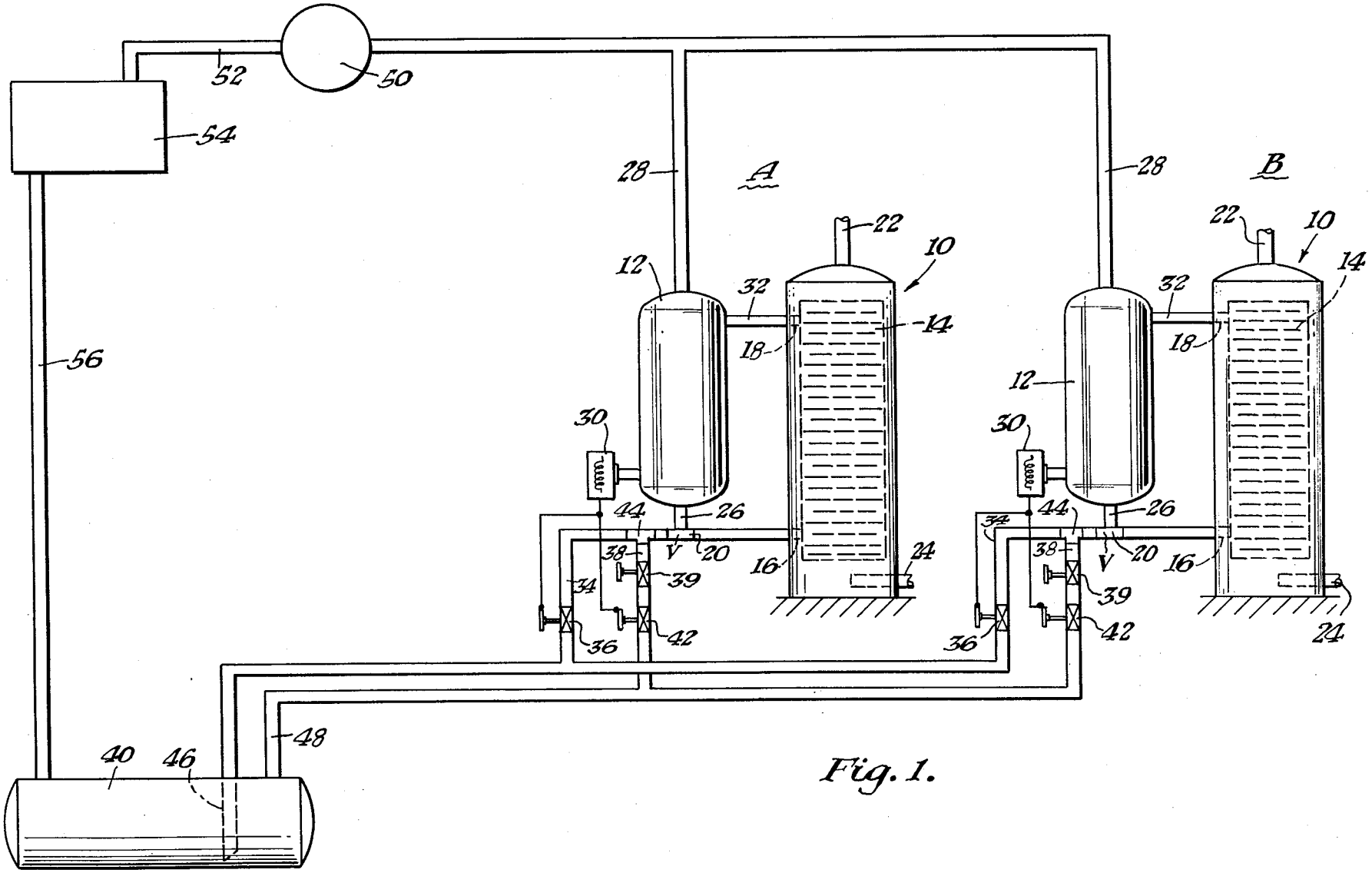
FIG. 1 is a schematic view of the present invention connected to a refrigeration system.

Referring now in detail to the drawing, wherein an embodiment of the present invention is shown, FIG. 1 illustrates an injector cooler system having at least two injector type coolers, A and B, connected to a common refrigeration system. Each injector cooler system generally has a heat exchange vessel 10 with cooling plates 14 connected to a surge tank 12 through inlet line 16 and outlet line 18. The heat exchanger 10 also has an inlet 22 and outlet 24 to pass the fluid to be cooled through the shell side of the heat exchanger 10.

The surge tank 12 is constructed such that it has two outlets, a liquid outlet 26 and a vapor outlet 28, and one inlet 32 connectable to the outlet 18 of the heat exchanger. The surge tank 12 also has at least one level detector device 30 for detecting the liquid refrigerant level in the surge tank 12.

The inlet line 16 of the heat exchanger 10 is connected to an injector nozzle 20 which draws down liquid from the surge tank 12 through outlet 26 when fluid flows through the injector nozzle 20. The upstream side of the injector nozzle 20 is connected to a receiver tank 40, which is common to all injector cooler systems, through two generally parallel pipe systems. One pipe system is a liquid transfer pipe 34 with a control valve 36 therein. The other pipe system is a vapor transfer pipe 38 which has a control valve 42 therein. Both liquid transfer pipe 34 and vapor transfer pipe 38 are tied together upstream of the injector nozzle 20 by a pipe tee 44, for example.

Generally, the upstream portion 46 of the liquid transfer pipe 34 extends near the bottom of the receiver 40, to insure a liquid suction, while the upstream portion 48 of the vapor transfer line 38 only extends to near the top of the receiver 40, to insure a vapor suction.

The refrigerant and vapor exiting the outlet 18 of the heat exchanger 10 enters the surge tank 12 through inlet 32. In the surge tank 10, the liquid refrigerant, for example ammonia, drops down to the bottom of the tank to be recycled through the injector nozzle 20 into the tube side 14 of the heat exchanger, while the vapor is drawn out through vapor outlet 28 to the suction of the compressor 50 where it is compressed. The discharge of the compressor 50 flows through pipe 52 to the evaporative condenser 54 where the compressed vapor is liquified and passes through pipe 56 to the common receiver 40.

In operation, the present invention is as follows: Vapor control valve 42 is normally closed and liquid control valve 36 is normally open, however, the control valves 42 and 36 for each individual injector cooler operate independently of the control valves 42 and 36 of each other injector cooler, that is, injector cooler system "A" operates independently of injector cooler system "B". With liquid control valve 36 open, liquid refrigerant will flow from receiver 40 through pipe portion 46, through control valve 36, through pipe portion 34, through injector nozzle 20 where the venturi action of the injector nozzle 20 will draw liquid refrigerant from the surge tank 12 to mix with the liquid refrigerant flowing from the receiver 20, and into the tube side 14 of the heat exchanger 10. The liquid refrigerant flowing through the tubes 14 picks up heat from the cooled liquid flowing through the shell side of the heat exchanger 10. The refrigerant and vapors carrying latent heat of vaporization, flow from the tubes 14 into the surge tank 12. When the refrigerant and vapors enter the surge tank 12 through inlet 32, the liquid refrigerant drops down to the bottom of the surge tank while the vapor exits the surge tank 12 through inlet 32, the liquid refrigerant drops down to the bottom of the surge tank while the vapor exits the surge tank 12 through outlet pipe 28. Once the vapor from each surge tank exits outlet 28, it combines to a single suction line for the compressor 50. After the compressed vapor is discharged from the compressor, it is condensed and deposited in the common receiver 40. Since, however, the injector cooler systems are low side fixed charge systems, the heat exchanger will try to pass all of the liquid refrigerant stored in the common receiver 40 to the suction side of the compressor. However, as the liquid refrigerant level in the surge tank 12 rises, the level detector device 30 will sense a predetermined high level and cause a signal to be transmitted to liquid transfer control valve 36 and vapor transfer control valve 46, whereby liquid transfer control valve 36 closes and vapor transfer control valve 42 opens. Thus, the heat exchanger 10 will continue to operate, but now, vapor refrigerant will flow from the top of the receiver 40 through pipe portion 48, through vapor transfer control valve 42, through a vapor metering device 39, through pipe portion 38, through injector nozzle 20 which will continue to draw down liquid refrigerant from the surge tank 12, and into the shell 14 of the heat exchanger 10. The continued venturi action of the injector nozzle 20 will lower the level of refrigerant in the surge tank 12 until the level detector device 20 senses a predetermined level, at which time a signal will be transmitted to the control valves 36 and 42 and again the liquid transfer control valve 36 will open and the vapor transfer control valve 42 will close. Thereafter, the control valves 36 and 42 will continue to cycle to prevent a high liquid level in the surge tank 12 from carrying over into the suction of the compressor 50.

Since each injector cooler system, for example A or B, independently controls the liquid refrigerant level in its respective surge tank 12, the injector cooler systems A and B may be connected to a common refrigeration plant.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An injector type refrigeration system for use in connecting at least two low side critical coolers to a common refrigeration loop, comprising:

a plurality of cooler means for cooling a liquid to be carbonated in said cooler means by a refrigerant, said cooler means having an inlet and outlet for fluidly connecting said liquid to be cooled, a tube type cooling element mounted within said cooler means having an inlet and outlet an interior for flowing said refrigerant therein and an exterior for contact with said liquid to be cooled, a surge tank means for absorbing changes in volume in said refrigerant having an inlet connected to the outlet of said tube type cooling element, a first outlet for discharging refrigerant vapor to a compressor, a second outlet for discharging liquid refrigerant to an injector nozzle for return to said cooler means inlet, and a level detection means for response to changes in liquid level in said surge tank, a receiver means for reception of refrigerant from a condensor, liquid refrigerant flow line means for transferring liquid refrigerant from said receiver means to said cooler, said liquid refrigerant flow line including a control valve responsive to signals from said level detection means and an injector nozzle means for extracting liquid from said surge tank when fluid flows from said receiver means to said cooler means inlet, and a refrigerant vapor flow line means for transferring refrigerant vapor from said receiver means to the suction of said injector nozzle means, said refrigerant vapor flow line means having a control valve responsive to signals from said level detection means for positioning said control valve in a position opposite said liquid refrigerant flow line control valve.

2. An injector type refrigeration system as set forth in claim 1, wherein:

said liquid refrigerant flow line control valve is normally in the open position and said refrigerant vapor flow line control valve is normally in the closed position.

3. An injector type refrigeration system as set forth in claim 2, wherein:

said liquid refrigerant flow line control valve and said refrigerant vapor flow line control valve simultaneously change valve positions on a high liquid refrigerant level signal from said level detector.

4. A method for using a single low side critical refrigeration loop including at least one common compressor, a common evaporative condensor, and a common receiver, to flow refrigeration simultaneously through a plurality of injector coolers, comprising the steps of:

discharging liquid refrigerant from said common receiver and causing said liquid refrigerant to flow through a liquid refrigerant line associated with each cooler to said cooler, each associated liquid refrigerant line having a control valve and an injector nozzle connected to one of said coolers, extracting liquid refrigerant by venturi action from a surge tank means for injection into said cooler when refrigerant from said receiver flows through said injector nozzle, said liquid refrigerant vaporizing while flowing through said cooler and returning to said surge tank, whereby refrigerant vapor flows to said compressor while liquid refrigerant is drawn out said injector nozzle, discharging vaporized refrigerant from said common receiver through a vapor refrigeration line having a control valve upon receipt of a high liquid level signal from said surge tank to said control valve in said vapor refrigeration line, said vapor refrigeration line, said vapor refrigeration line connected from said common receiver to said liquid refrigeration line upstream of said injector nozzle, said liquid refrigerant line control valve securing flow therethrough while a high liquid level signal is present in said surge tank.

* * * * *